US005743072A

United States Patent [19]

Chang

[11] Patent Number: 5,743,072

[45] Date of Patent: Apr. 28, 1998

[54] SADDLE CINCH

[76] Inventor: Ju-Sung Chang, 4, Lane 48, Min Sheng 3 Street, Tsaotwen, Nantou, Taiwan

[21] Appl. No.: 723,886

[22] Filed: Oct. 1, 1996

[51] Int. Cl.[6] ..... B68C 1/14

[52] U.S. Cl. ..... 54/23

[58] Field of Search ..... 54/4, 23, 35

[56] References Cited

U.S. PATENT DOCUMENTS

| | | | |
|---|---|---|---|
| 3,805,491 | 4/1974 | Deal | 54/23 |
| 4,434,604 | 3/1984 | Bird | 54/23 |
| 5,426,924 | 6/1995 | Harty | 54/23 |

*Primary Examiner*—Robert P. Swiatek

*Attorney, Agent, or Firm*—Beveridge, DeGrandi, Weilacher & Young LLP

[57] ABSTRACT

A saddle cinch comprises a belt and a breathable protective jacket fitted over the belt such that both longitudinal ends of the protective jacket are fastened respectively with two fastening segments located at both longitudinal ends of the belt, and that buckles fastened respectively with both longitudinal ends of the belt are located outside both longitudinal ends of the protective jacket, and further that the retaining rings fastened with the midsegment of the belt are located outside the protective jacket via the through holes located at the midsegment of the protective jacket. The protective jacket is provided in the outer surface thereof with a plurality of free grooves which are arranged equidistantly such that they intersect one another to form therebetween a plurality of knobs having a smooth top. The grooves of the protective jacket serve as air vents when the saddle cinch is fastened around the belly of a horse, whereas the knobs of the protective jacket serve as contact points to locate the saddle cinch on the belly skin of the horse.

1 Claim, 2 Drawing Sheets

SADDLE CINCH

FIELD OF THE INVENTION

The present invention relates generally to a horse riding equipment, and more particularly to an improved cinch for fastening a saddle on a horseback.

BACKGROUND OF THE INVENTION

There are a variety of saddle cinches available in the market today. However, these conventional saddle cinches are generally defective in design in that they are susceptible to the sideways sliding motion capable of undermining the fastening of a saddle on a horseback, and that they obstruct the perspiration of the horse belly, thereby subjecting the horse to the skin discomfort or disorder.

SUMMARY OF THE INVENTION

The primary objective of the present invention is therefore to provide an improved saddle cinch which is free from the shortcomings of the conventional saddle cinch.

In keeping with the principle of the present invention, the foregoing objective of the present invention is attained by a saddle cinch, which is made up of a belt and a protective jacket. The belt is provided respectively at both longitudinal ends thereof with a fastening segment and a buckle fastened therewith. The belt is further provided at the midsegment thereof with retaining rings. The belt is fitted into the protective jacket such that the buckles are located outside both longitudinal ends of the protective jacket, and that the fastening segments of the belt are fastened securely with both longitudinal ends of the protective jacket. The protective jacket is provided at the midsegment thereof with through holes corresponding in location to the retaining rings of the belt. The protective jacket has in the outer surface thereof a plurality of grooves which are arranged equidistantly such that they intersect one another to form therebetween a plurality of knobs having a smooth top. The grooves of the protective jacket serve as ventilation apparatus when the saddle cinch of the present invention is fastened around the abdomen of a horse, whereas the knobs of the protective jacket provide the saddle cinch with a gripping effect capable of preventing the cinch from sliding sideways on the abdomen skin of a horse.

The foregoing objective, features and advantages of the saddle cinch of the present invention will be more readily understood upon a thoughtful deliberation of the following detailed description of an embodiment of the present invention in conjunction with the accompanying drawings.

DETAILED DESCRIPTION OF THE EMBODIMENT

Figures 1, 2:
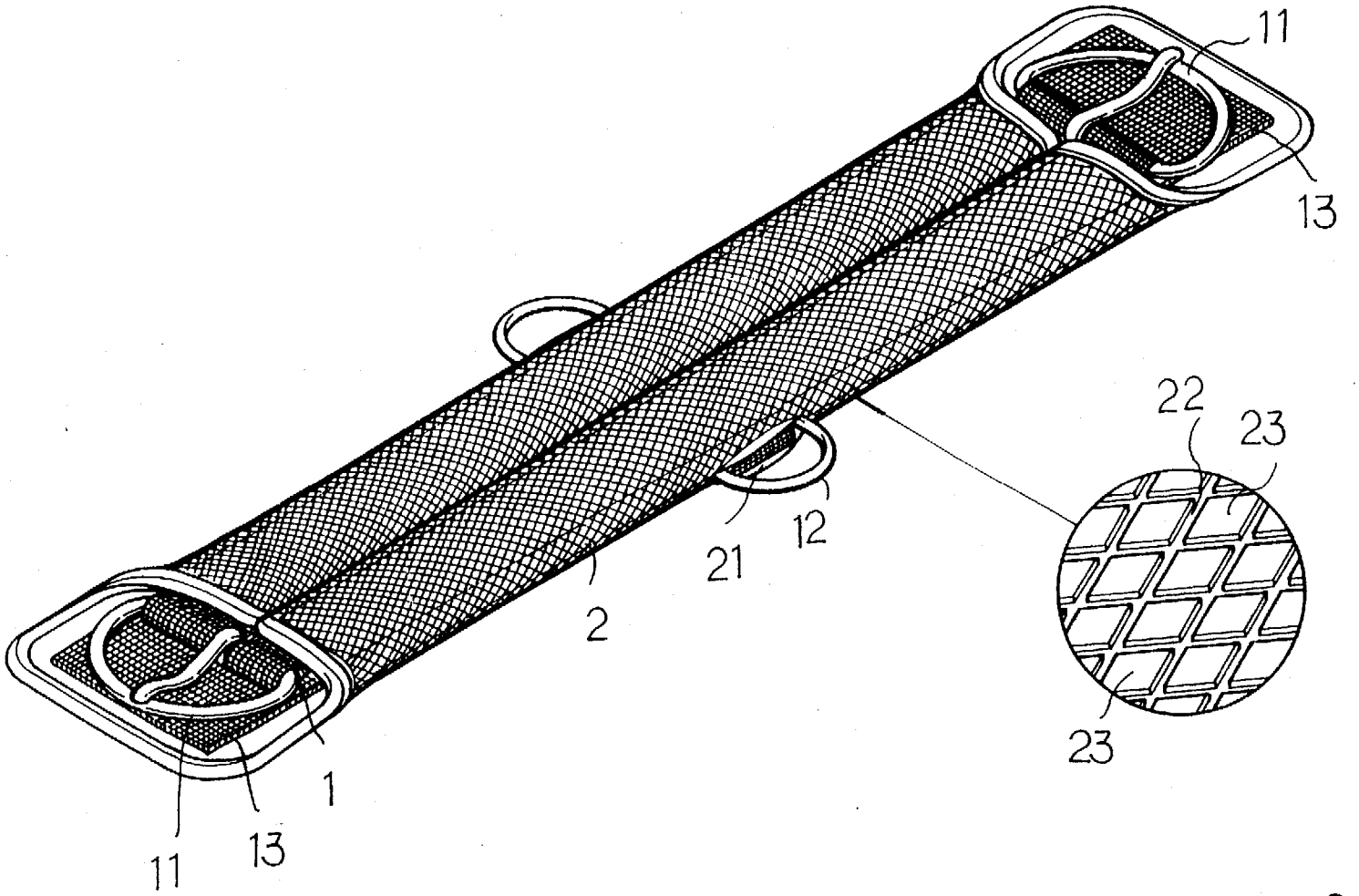
FIG. 1 shows a perspective schematic view of a saddle cinch of the present invention.
FIG. 2 shows a partial enlarged view of the outer surface of the protective jacket of the saddle cinch of the present invention.

As shown in FIGS. 1 and 2, a saddle cinch embodied in the present invention is composed of a belt 1, and a breathable protective jacket 2 which is fitted over the belt 1.

The belt 1 is provided respectively at both longitudinal ends thereof with a buckle 11 fastened securely therewith. The belt 1 is further provided respectively at both longitudinal ends thereof with a fastening segment 13. In addition, the belt 1 is provided at the midsegment thereof with retaining rings 12 fastened securely therewith. The belt 1 is fitted into the protective jacket 2 such that the buckles 11 of the belt 1 are located respectively outside the longitudinal ends of the protective jacket 2, and that the fastening segments 13 of the belt 1 are fastened respectively with the longitudinal ends of the protective jacket 2 so as to ensure that the belt 1 and the protective jacket 2 are joined together securely.

Figure 3:
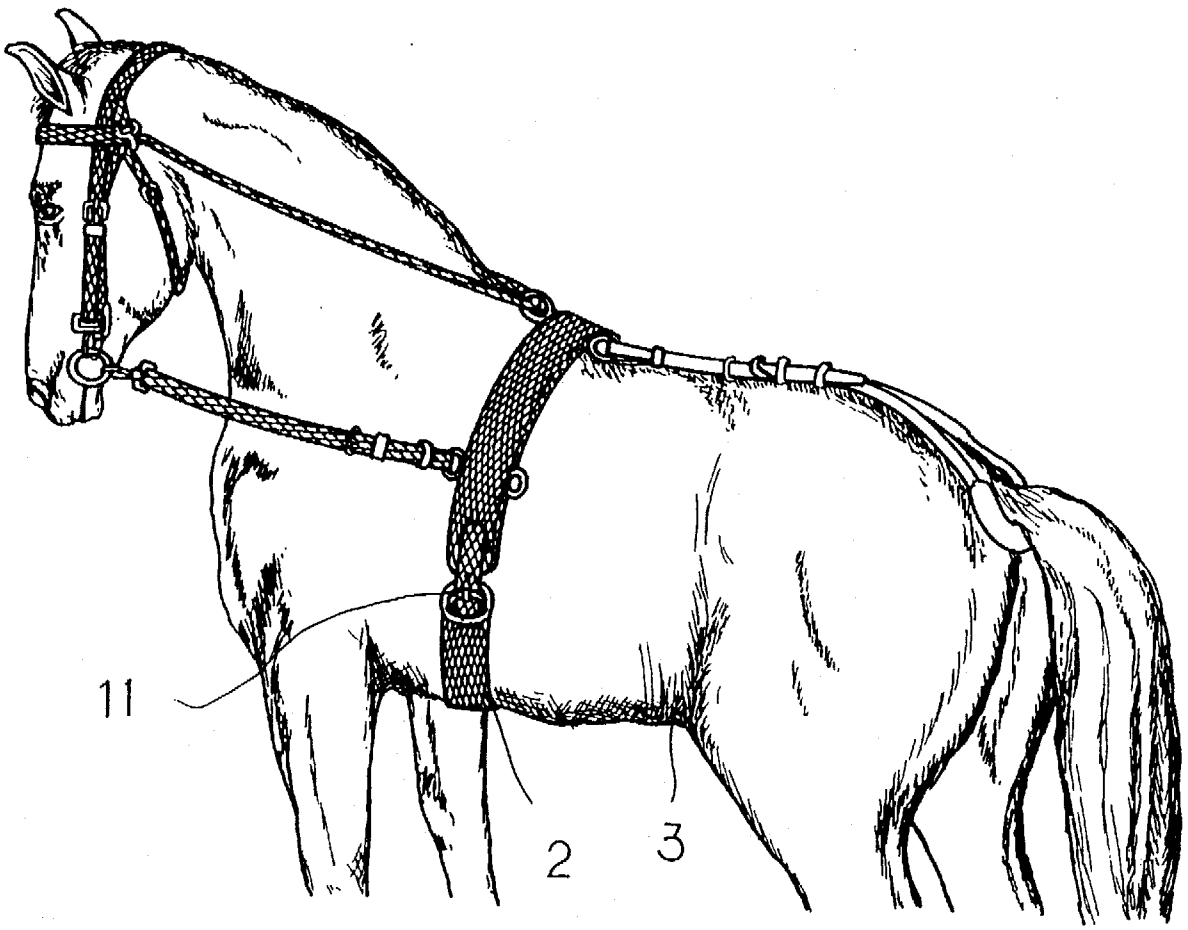
FIG. 3 shows a schematic view of the present invention at work.

The protective jacket 2 is provided at the midsegment thereof with through holes 21 through which the retaining rings 12 of the belt 1 are located outside the protective jacket 2. The protective jacket 2 is further provided in the outer surface thereof with a plurality of fine grooves 22, which are arranged equidistantly such that they intersect one another to form therebetween a plurality of knobs 23 having a smooth top. The grooves 22 serve as ventilation apparatus when the saddle cinch of the present invention is fastened around the abdomen of a horse 3, as shown in FIG. 3. The knobs 23 provide the saddle cinch of the present invention with a gripping effect capable of preventing the saddle cinch from sliding sideways on the abdomen skin of the horse 3.

It is therefore readily apparent that the saddle cinch of the present invention has inherent advantages over the conventional saddle cinch. The grooves 22 of the protective jacket 2 of the saddle cinch of the present invention serve as air vents to avert the skin discomfort or disorder caused by the perspiration problem. In addition, the knobs 23 of the protective jacket 2 of the saddle cinch of the present invention provide a plurality of contact points to enable the saddle cinch of the present invention to be located securely around the belly of a horse. Moreover, the knobs 23 are capable of massaging the skin of a horse so as to tame the horse. In other words, the horse will find the saddle cinch of the present invention less objectionable.

The embodiment of the present invention described above is to be regarded in all respects as being merely illustrative and not restrictive. Accordingly, the present invention may be embodied in other specific forms without deviating from the spirit thereof. The present invention is therefor to be limited only by the scope of the following appended claim.

What is claimed is:

1. A saddle cinch comprising:

a belt provided respectively at both longitudinal ends thereof with a fastening segment and a buckle fastened therewith, said belt further provided at a midsegment thereof with retaining rings fastened therewith; and a protective jacket provided at a midsegment thereof with through holes and fitted over said belt such that said protective jacket is fastened securely and respectively at both longitudinal ends thereof with said fastening segment of said belt, and that said retaining rings of said belt are located outside said protective jacket via said through holes of said protective jacket;

wherein said protective jacket is provided in an outer surface thereof with a plurality of free grooves arranged equidistantly such that said grooves intersect one another to form therebetween a plurality of knobs having a smooth top.

* * * * *